US009719340B2

(12) United States Patent
Scharmach et al.

(10) Patent No.: US 9,719,340 B2
(45) Date of Patent: Aug. 1, 2017

(54) METHOD OF CONTROLLING A PROPPANT CONCENTRATION IN A FRACTURING FLUID UTILIZED IN STIMULATION OF AN UNDERGROUND FORMATION

(71) Applicants: William Scharmach, Grand Island, NY (US); Daniel Dalton, Rock Springs, CO (US); Gregory J. Panuccio, Amherst, NY (US)

(72) Inventors: William Scharmach, Grand Island, NY (US); Daniel Dalton, Rock Springs, CO (US); Gregory J. Panuccio, Amherst, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 392 days.

(21) Appl. No.: 14/308,130

(22) Filed: Jun. 18, 2014

(65) Prior Publication Data

US 2015/0060065 A1 Mar. 5, 2015

Related U.S. Application Data

(60) Provisional application No. 61/872,344, filed on Aug. 30, 2013.

(51) Int. Cl.

| | |
|---|---|
| ***B01F 5/04*** | (2006.01) |
| ***E21B 43/267*** | (2006.01) |
| ***B01F 15/04*** | (2006.01) |
| ***E21B 43/26*** | (2006.01) |
| ***B01F 15/00*** | (2006.01) |

(52) U.S. Cl.

CPC ..... *E21B 43/267* (2013.01); *B01F 5/0418* (2013.01); *B01F 15/00233* (2013.01); *B01F 15/0429* (2013.01); *E21B 43/26* (2013.01)

(58) Field of Classification Search

CPC ..... E21B 43/267; E21B 43/26; B01F 5/0413; B01F 2005/0448; B01F 15/00233; B01F 15/0429

See application file for complete search history.

(56) References Cited

U.S. PATENT DOCUMENTS 4,374,545 A * 2/1983 Bullen ..... B62B 1/18
4,448,709 A 5/1984 Bullen
(Continued)

FOREIGN PATENT DOCUMENTS

CA 2220972 C 3/1999
CA 2716446 A 4/2012
(Continued)

OTHER PUBLICATIONS

Michael J. Economides, T.M. (2007) Modem Fracturing: Enhancing Natural Gas Production. (S. Weiss, Ed.) Houston, TX, USA: Energy Tribune Publishing, Inc.

*Primary Examiner* — Charles Cooley
(74) *Attorney, Agent, or Firm* — Iurie A. Schwartz

(57) ABSTRACT

A system and method is described that provides for proppant to be blended into a liquefied gas fluid stream with an eductor to produce a proppant slurry which is effectively controlled by the use of a control valve system and associated PLC controller. This system ensures allowing for operation of the system at various static pressures and keeps the proppant completely fluidized throughout the fracing operation.

15 Claims, 6 Drawing Sheets

Overall control scheme for preparing fracing slurry.

(56) References Cited

U.S. PATENT DOCUMENTS

| | | | | |
|---|---|---|---|---|
| 4,627,495 | A | 12/1986 | Harris et al. | |
| 4,701,270 | A | 10/1987 | Bullen et al. | |
| 4,830,794 | A | 5/1989 | Edgley et al. | |
| 5,423,205 | A * | 6/1995 | Farchone | B01F 15/00136 |
| 5,515,920 | A | 5/1996 | Luk et al. | |
| 5,558,160 | A | 9/1996 | Tudor | |
| 5,899,272 | A | 5/1999 | Loree | |
| 6,955,704 | B1 | 10/2005 | Strahan | |
| 7,018,451 | B1 | 3/2006 | Torkildsen et al. | |
| 7,213,651 | B2 | 5/2007 | Brannon et al. | |
| 7,252,700 | B1 | 8/2007 | Strahan | |
| 7,581,590 | B2 | 9/2009 | Lesko et al. | |
| 7,620,481 | B2 | 11/2009 | Dykstra | |
| 7,673,685 | B2 | 3/2010 | Huntley Shaw et al. | |
| 7,677,309 | B2 | 3/2010 | Shaw et al. | |
| 7,726,404 | B2 | 6/2010 | Kubala et al. | |
| 7,735,551 | B2 | 6/2010 | Vozniak et al. | |
| 8,025,099 | B2 | 9/2011 | Mesher | |
| 8,066,068 | B2 | 11/2011 | Lesko et al. | |
| 8,276,659 | B2 | 10/2012 | Fordyce et al. | |
| 8,408,289 | B2 * | 4/2013 | Loree | C09K 8/64 |
| 8,490,700 | B2 | 7/2013 | Lesko et al. | |
| 8,636,065 | B2 | 1/2014 | Lesko et al. | |
| 8,689,876 | B2 | 4/2014 | Loree et al. | |
| 8,757,259 | B2 | 6/2014 | Lesko et al. | |
| 8,763,699 | B2 | 7/2014 | Medvedev et al. | |
| 9,580,641 | B2 * | 2/2017 | Kelly | C09K 8/68 |
| 2006/0289166 | A1 | 12/2006 | Stromquist et al. | |
| 2007/0000666 | A1 * | 1/2007 | Vozniak | E21B 43/267 |
| 2010/0155066 | A1 | 6/2010 | Fordyce | |
| 2011/0105370 | A1 | 5/2011 | Mesher et al. | |
| 2011/0146994 | A1 * | 6/2011 | Lewis | E21B 43/26 |
| 2011/0284230 | A1 | 11/2011 | Loree et al. | |
| 2012/0318514 | A1 | 12/2012 | Mesher | |
| 2012/0325472 | A1 | 12/2012 | Litvinet et al. | |
| 2013/0168086 | A1 | 7/2013 | Roberts | |
| 2013/0186808 | A1 | 7/2013 | Tomiyoshi et al. | |
| 2013/0228330 | A1 | 9/2013 | Loree et al. | |
| 2013/0259575 | A1 | 10/2013 | Hoier et al. | |
| 2013/0299159 | A1 | 11/2013 | O'Rourke et al. | |
| 2013/0299167 | A1 | 11/2013 | Fordyce et al. | |
| 2014/0000720 | A1 | 1/2014 | Mortzheim et al. | |
| 2014/0138085 | A1 | 5/2014 | Lesko et al. | |
| 2014/0151049 | A1 | 6/2014 | Sanborn et al. | |
| 2014/0151051 | A1 | 6/2014 | Lissianski et al. | |
| 2014/0174747 | A1 * | 6/2014 | Kelly | E21B 43/267 |
| 2014/0202702 | A1 * | 7/2014 | Cobb | B01F 5/0614 |
| 2014/0251623 | A1 * | 9/2014 | Lestz | E21B 43/26 |
| 2014/0262285 | A1 | 9/2014 | Sethna et al. | |
| 2014/0299321 | A1 | 10/2014 | Burnette et al. | |
| 2015/0060044 | A1 * | 3/2015 | Scharmach | B01F 5/043 |
| 2015/0060065 | A1 * | 3/2015 | Scharmach | E21B 43/267 |
| 2015/0167441 | A1 * | 6/2015 | Howell | E21B 41/00 |

FOREIGN PATENT DOCUMENTS

| | | | |
|---|---|---|---|
| GB | 1439735 | A | 6/1976 |
| WO | WO 2007/098606 | A1 | 9/2007 |
| WO | WO2010130037 | A1 | 11/2010 |
| WO | WO2011000089 | A1 | 1/2011 |
| WO | WO2012087388 | A1 | 6/2012 |
| WO | WO 2013/014434 | A2 | 1/2013 |

* cited by examiner

Overall control scheme for preparing fracing slurry.

The resulting proppant concentration (top) as a function of proppant control valve position and pad pressure (bottom) for the "low" pad pressure condition The resulting proppant concentration (top) as a function of proppant control valve position and pad pressure (bottom) for the "high" pad pressure condition

METHOD OF CONTROLLING A PROPPANT CONCENTRATION IN A FRACTURING FLUID UTILIZED IN STIMULATION OF AN UNDERGROUND FORMATION

The present application claims priority from U.S. Provisional Application Ser. No. 61/872,344, filed Aug. 30, 2013, which is incorporated by reference herein in its entirety.

FIELD OF INVENTION

A control system and associated methodology and apparatus for the implementation of an eductor-mixer technique providing the capability for injecting proppant material into a non-aqueous fracturing fluid stream utilized in hydraulic fracturing operations is described. The system and apparatus includes an eductor, an enclosed vessel that provides a proppant reservoir, valving disposed between the eductor and the enclosed vessel, and a pressure control system for modifying the pressure in the enclosed proppant vessel during the fracturing operation. The control system employs a combination of control valve position and proppant reservoir pressure to adjust and set proppant feed rates into an eductor to be mixed with a non-aqueous fluid and to control proppant concentrations into a fracturing fluid stream.

BACKGROUND OF THE INVENTION

The use of carbon dioxide for enhanced production of oil and gas from reservoirs is well known. Liquefied gas based fracturing is unique as compared to conventional fluids such as water and have certain advantages in water sensitive and low pressure formations, including the promotion of fluid flowback (i.e., retrieval of water/fluid used in fracture treatment) which minimizes formation damage caused by water. Michael J. Economides, T. M. (2007). Modern Fracturing: Enhancing Natural Gas Production. (S. Weiss, Ed.) Houston, Tex., USA: Energy Tribune Publishing Inc. $LCO_2$ used in fracturing treatments is typically added to a high pressure stream of water and proppant (typically solids, such as sand, polymer pellets, tracers, gravel, etc. of various sizes and density) at the well-head. Combining water with proppant and adding a separate pressurized $LCO_2$ stream is the most conventional method of forming a $CO_2$-energized fracture fluid. This is due, in large part, because it is simpler to mix proppant with water at atmospheric pressure then it is to add proppant to liquid carbon dioxide at a pressure above the triple point of carbon dioxide, (i.e., greater than 75.1 psia).

Equipment is available and can be used for small fracture treatments (e.g. to place up to approximately 20 tons of proppant) to mix proppant directly with a liquid carbon dioxide-based fracturing fluid. This equipment includes a pressurized vessel and manifold system that blends the proppant into a liquid $CO_2$ stream prior to the high-pressure pumps. Proppant is loaded into the $CO_2$ blender. The blender is sealed and then filled with $CO_2$. During the fracturing process, proppant is mixed into the fracturing fluid by either hydraulically driven augers or gravity fed through a control valve. Michael J. Economides, T. M. (2007). Modern Fracturing Enhancing Natural Gas Production. (S. Weiss, Ed.) Houston, Tex., USA: Energy Tribune Publishing Inc. Once the batch of $LCO_2$ and proppant is exhausted, the fracture treatment must either be completed or suspended to refill the blender with additional proppant.

Earlier efforts, as described in U.S. Pat. No. 4,374,545, provide for a batch process creating a proppant and $LCO_2$ fracturing slurry. Each unit is capable of metering up to 20 tons of a single type of proppant and addresses the control of proppant supply through the use of a metering auger. $LCO_2$ additions made to the bottom of the tank allow for a flowable and vapor-free proppant slurry leaving the system as well as maintaining pressure in the vessel.

Another system is described in U.S. Pat. No. 8,408,289 and U.S. Pat. No. 8,689,876 which depict an upright standing vessel where proppant is metered into LPG (liquefied petroleum gas) as a base fracturing fluid. Proppant loadings are varied into the LPG fracturing fluid stream through the use of gravity (through a control valve) or via one or more augers disposed within and along the bottom of the proppant supply source or arranged outside of the proppant supply source. Inert gas (in the form of nitrogen) is pumped into the vessel during operation to maintain vessel pressure to ensure the LPG mix remains in the liquid phase to prevent back flow into the vessel.

A non-mechanical pump, such as an eductor, can be used to mix a proppant into a fracturing fluid stream. Non-mechanical pumps have the benefit of no moving parts, are generally low cost and simple pieces of equipment, and are already commonly used in related material introduction. For instance, International Publication No. WO 2012087388 describes an eductor system for introducing and blending polymer additives into a fracturing fluid stream.

General use of a liquid eductor for solids handling and blending relies heavily on the relationship of motive flow (i.e., the incoming flow of fluid to the eductor (without proppant addition)) to the rate of solids entrainment for the control of solids concentration. As liquids pass through the converging nozzle of the eductor, potential energy is converted into kinetic energy resulting in a high velocity jet flow. This change in energy results in a localized decrease in static pressure that creates suction within the body of the eductor. This suction allows material to be drawn into the eductor and entrained by the fluid ($LCO_2$, etc.). The eductor serves a dual purpose: mixing within the nozzle as well as drawing material into the fluid to ensure intimate mixing. With more conventional methods, such as using sand or similar material proppants to provide water-based slurries, the viscous properties of the water aids in drawing solid materials into the body of the eductor where suction occurs. Difficulty arises when it is necessary to establish a particulate suspension in a relatively low viscosity fluid (as compared to water), such as liquid carbon dioxide ($LCO_2$). The present invention addresses the need to add proppant to such fluids on a more fully controlled basis by delivering a homogeneous fracturing fluid to high pressure pumpers prior to wellhead injection.

A system and method described in U.S. Pat. No. 7,735,551 is used to blend nitrogen gas with proppant to fracture an underground oil and gas formation or coal seam. The proppant and gas mixing occurs at a pressure sufficient to fracture the formation. In one embodiment, an eductor is employed to introduce proppant into the vapor stream and is in communication with the well bore. Proppant material is either gravity fed from a proppant reservoir into the eductor with the use of a control valve or regulated in with the use of an auger. The system described provides for the use of either valve position or auger speed to regulate proppant into the vapor stream to achieve specified proppant loadings. Pressure in the head space of the proppant reservoir is maintained at a constant value during the entirety of the stimulation.

To overcome the disadvantages of the related art, it is an object of the present invention to provide a control mechanism for operating a system for the delivery of proppant into a liquefied gas, such as $LCO_2$, for the purpose of fracturing a subterranean formation. Although the liquefied gas discussed herein is in relation to $LCO_2$, by way of example, it can be combination of immiscible and non-immiscible fluids such a $CO_2$ and methanol, $CO_2$ and biodiesel, or $CO_2$ and water. Specifically, the control mechanism developed utilizes an eductor along with a proppant control valve and the pad pressure (as defined below) in the proppant reservoir to control proppant loading at specified concentrations in a substantially homogeneous fashion.

It is another object of the present invention to provide a system designed to mix proppant and fracturing fluid at pressures significantly below that of the surface treatment pressure (e.g. at or below 400 PSI).

It is yet another object of the present invention to provide a system where the eductor can be used with a liquid, and wherein said system does not utilize an auger for purposes of metering proppant into fracturing fluid.

Other objects and aspects of the present invention will become apparent to one skilled in the art upon review of the specification, drawings and claims appended hereto.

SUMMARY OF THE INVENTION

The present invention describes a system and associated apparatus for modifying entrainment rates of proppant with liquefied gas or a relatively low viscosity (that is less than water at 1 centiPoise—cP) liquid, (e.g. carbon dioxide) using an eductor. More specifically, this system employs the use of a proppant reservoir, valving, an eductor, and a pressure source to provide the proper concentration of proppant in a flowing stream of fracturing fluid for use in stimulating subterranean formations such as new and existing oil and gas wells. An auger is not used to meter proppant flow in the present invention. The vessel is sealed from the atmosphere in order to achieve proper pressure modification. Operating pressure of the equipment in the present invention, including the proppant reservoir and the eductor, is in the range of about 100 to 400 PSI.

A solids-conveying liquid eductor is used to mix and accelerate proppant within the main liquid stream. The eductor can be varied in size (with different nozzle and tail) to accommodate the flow rates required for the particular well. Once the flow requirement for the motive stream has been determined, a control system is implemented. The control system utilizes at least one valve for controlling the flow of proppant from one or more pressurized proppant reservoir into the eductor; thereby mixing the material with the motive stream. Gas and/or liquid is fed to the top of the proppant reservoir to control the static pressure (as defined below) inside the proppant reservoir. Modifying the static pressure inside the proppant reservoir extends the range of achievable proppant flow rates from the reservoir into the eductor.

In one aspect of the invention a method of controlling a proppant concentration in a fracturing fluid that is utilized in stimulation of an underground formation is provided. The method includes:

supplying a motive fluid flow of liquefied gas at pressure between about 150 to 400 psig to an eductor, wherein the liquefied gas is mixed with the proppant or proppant slurry in the eductor to form a fracturing fluid, wherein the pressurized proppant reservoir is disposed in a position to supply the proppant slurry to at least one eductor;

A. varying the pad pressure in the pressurized proppant reservoir from about −30 to 40 psi; and B. further varying a proppant control valve disposed between the eductor and the pressurized proppant reservoir to control the proppant concentration in a range from about 0.1 to 10 lbs/gal of proppant in the fracturing fluid.

In another aspect of the invention, a system for controlling proppant concentration in a fracturing fluid that is utilized in stimulation of an underground is provided. The system includes:

A. providing a proppant reservoir having a proppant or proppant slurry therein;

B. providing an eductor to receive a motive fluid flow of liquefied gas, wherein the eductor is disposed below the proppant reservoir and forms a fluid containing proppant at the outlet of the eductor upon receiving the proppant or proppant slurry from the proppant reservoir; and C. providing a proppant control valve disposed between the proppant reservoir and the eductor, wherein the pad pressure in the proppant reservoir is varied from about −30 to 40 psi to attain a concentration range from about 0.1 to 10 lbs/gal of proppant in the fracturing fluid.

BRIEF DESCRIPTION OF THE DRAWINGS

The above and other aspects, features, and advantages of the present invention will be more apparent from the following drawings, wherein.

DETAILED DESCRIPTION OF THE INVENTION

Figure 1:
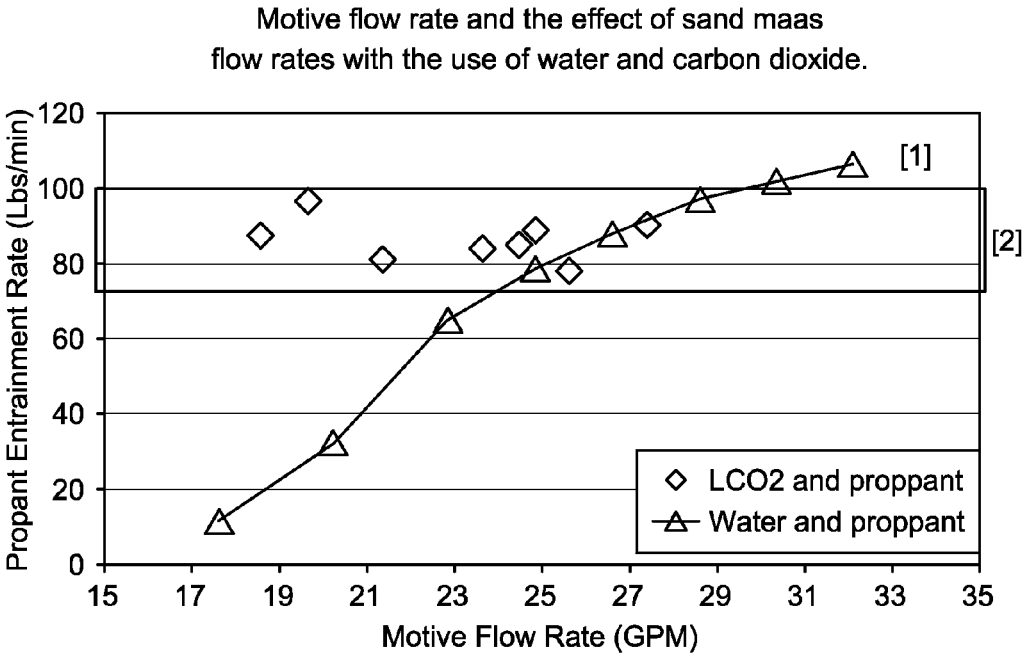
FIG. 1 is a plot that illustrates the differences between the motive flow rate and the effect of sand/proppant mass flow comparing the use of water and liquefied carbon dioxide.

The present invention involves a system and apparatus for providing a continuous or semi-continuous supply of fracturing liquid, where the flow rate and method of controlling the flow rate utilizes an eductor so that proppant can be thoroughly mixed with the fluid during creation of a fracturing fluid stream and is controlled through the use of control valves and proppant reservoir pressures. As employed herein, "fracturing fluid" or "fracturing liquid" are used interchangeably, and refers to the product routed downstream to the fracturing pump. The eductor and associated valving must be properly sized in order to provide efficient acceleration of the proppant and resulting combined fluid proppant slurry at the desired concentration—depending on the required fracturing liquid flow rate. Eductors that may be employed includes for example, jet pumps, ejectors, venturi pumps, siphon pumps, aspirators, mixing tees, injector pumps, etc. The eductors can include a variable size nozzle or aperture, which may be controlled through a programmable logic controller, or the like, to maintain net positive suction head (NPSH) pressure downstream of the proppant reservoir, discussed below. This enables the use of a broad range of flow rates without changing the nozzle or the eductor itself. On the suction side of the eductor, a large reservoir (referred to as the proppant reservoir) is positioned for holding either dry proppant or proppant slurry (a mixture of proppant and liquefied gas potentially with other additives). The flow of proppant or slurry from the reservoir to the fluid stream is controlled by a valve disposed between the eductor and the reservoir. For the purposes of the present disclosure, this valve will be referred to as the "proppant control valve". This proppant control valve can be one of many types including that of a sliding gate, knife valve, pinch valve, and choke valve. The proppant is loaded into the reservoir either via a hatchway or through pneumatic filling and then the vessel is sealed. Dry gas(es) or liquefied gases may then be added to the system. Dry gas is usually added to the top of the reservoir in order to prevent the aerosolization of proppant.

Liquefied gas can be added through the bottom of the reservoir through the separate liquid line (denoted as the liquid addition line) attached to the bottom of the vessel or alternatively into the suction side of the eductor. Liquefied gas is added to the bottom of the reservoir initially to prevent the formation of gas pockets. During the fracturing treatment, liquefied gas may also be added to the bottom of the reservoir in order to promote the formation of a solid-liquefied gas suspension.

Preparation of the system and use of the apparatus to conduct the process methodology is generally described as follows: proppant is loaded into the proppant reservoir and the reservoir is pressurized with gas to a pressure above the triple point pressure of the liquefied gas to ensure liquid remains in the reservoir as liquefied gas is added.

Once the motive flow has been established, the proppant control valve is opened to commence mixing proppant material with the fracturing fluid stream. The proppant loading in the fracturing fluid and/or the flow rate of the combined stream are normally measured by the use of a nuclear densitometer, a magnetic flow meter, a Coriolis meter or other suitable measurement devices. In the present invention, adjustments of the opening of the proppant control valve position (i.e., between various size openings) is determined based on the measured concentration of the solids either via manual methods or through the use of an automatic, computer controlled, control loop. The control of the opening and closing of the valve allows for proper metering of the proppant to the eductor. The concentration of solids in the fracturing fluid is synonymous with proppant loading. Adjustment of the static pressure in the proppant reservoir is used to provide a greater range of operability of the valve (as described in detail, below). Metering of the proppant by adjusting the proppant control valve and static pressure in the proppant reservoir allows for providing the desired loading of the proppant on a per gallon (or other unit of liquid measure) basis of fracturing fluid. This loading or concentration is normally in the range of at least 0.1 to 10 lbs per gallon. An even more preferable range for certain fracturing operations is between 0.1 and 4 lbs/gallon.

The use of pad pressure (defined in this invention as the difference in pressure in the headspace of the proppant reservoir and the outlet of the eductor) provides the requisite static pressure that extends the overall capability to attain the desired proppant loadings. The static pressure in the reservoir, in the present invention, is measured as the difference in pressure at the bottom of the reservoir compared to the pressure measured at the discharge of the eductor pump.

Changes in static pressure are generally achieved by controlling the flow of pressurized gas (such as gaseous carbon dioxide or nitrogen) or liquid (such as liquefied carbon dioxide) fed to the top of the proppant reservoir. In addition, a pressure relief control valve may be used to release excess pressure in the reservoir's head space. Ideally, pad pressure is varied over the course of the fracturing operation and the range of operation is maintained between −20 and 30 psi. Excessive pad pressure can result in higher proppant loading than desired in the fracturing fluid stream. A pad pressure that is too high could result in an increased sensitivity of the proppant control valve and precise control of the desired proppant concentrations could be more difficult to achieve. In this case, the pad pressure should be decreased. Alternatively, a pad pressure that is too low can result in limiting proppant flow from the proppant reservoir such that the concentration of proppant in the fracturing fluid is lower than the set point. In this case, the pad pressure should be increased.

Operating static pressures and eductor discharge pressures must be maintained in excess of the vapor pressure of the fracturing fluids at the operating temperature and/or exceed a required NPSH. For instance, maintaining the proper pressure to ensure liquid carbon dioxide ($LCO_2$) remains a single phase fluid (liquid) within the high pressure fracturing pumps requires approximately 50 psi NPSH, or at least a pressure sufficiently above saturation conditions for normal, safe, and reliable operation of the high pressure pumps. Significant amounts of vapor or a provision of lower NPSH fluid risks vapor lock or cavitation. These conditions will negatively affect performance and can damage the high pressure pumps. Because of the risk of vapor lock and cavitation, operators must be cognitive of pressure drops required to ensure proper eductor pump operation.

Recommended operational pressure ranges for eductor pumps is normally between 15 psi and 60 psi, depending on the available "disposable" NPSH (or pressure available to the operator to ensure proper eductor performance while maintaining sufficient pressure above saturation as described above). Motive flow rates failing to produce at least a 10 psi or greater pressure drop in the eductor will result in improperly cleared proppant or proppant flooding in the downstream piping.

A bypass line for the fracturing fluid is connected around the eductor and may also be utilized to provide for increasing flow rate capabilities of fracturing fluid without incurring higher pressure drops across the eductor pump or to further dilute the concentration of the proppant in the fracturing fluid leaving the eductor. This is especially beneficial when higher than expected flow rates of fracturing fluid are required so that an appropriate level of net positive suction head (NPSH) can be maintained. For instance, if a fracturing treatment requires a pumping rate of 40 BBLS/min and the installed eductor is only capable of operating up to 30 BBLS/min before the discharging pressure is in danger of maintaining the necessary NPSH, 10 BBLS/min flow can be bypassed around the eductor, resulting in a total flow of 40 BBLS/min, at a cost of reducing the maximum proppant concentration producible by the blending unit into the fracturing fluid stream.

The actual operation of the system is described using two separate stages;

A. The Pre-Startup Stage:

During pre-start up, the following steps are followed:

(1) The proppant reservoir is isolated from the eductor and proppant/sand is loaded into the proppant reservoir through either the port located on the top of the reservoir or through pneumatic fill lines.
(2) The proppant reservoir is then pressurized using the vapor addition line at the upper part of the reservoir.
(3) The proppant reservoir vessel is then filled with liquid through a liquid line located at the lower part of the vessel.
  a. Concurrently, liquid additions could be provided to the top of the proppant reservoir either for filling or maintaining liquid levels in the reservoir.
  b. The pressure relief control valve is used to maintain a prescribed pressure in the proppant reservoir during filling.
(4) Once filling is completed, the operational stage can begin.

B. Operational Stage:
(1) The fluid or motive is pumped down the main fluid line through the eductor.
  a. A bypass line which bypasses the eductor may be used to extend fracturing fluid flows rates beyond the limitations caused by the pressure drop through the eductor, and possibly prevent cavitation of the downstream pumps.
(2) The proppant control valve is then opened and proppant is allowed to mix into the main fluid line within the eductor.
  a. An isolation valve could be located next to the proppant control valve to act as a seal in the event that the proppant control valve does not function as a leak tight valve.
(3) Pad pressure is regulated to a set value. Pad pressure is increased by flowing pressurized gas (or liquid) to the top of the proppant reservoir. Pad pressure is decreased by opening the pressure relief control valve.
(4) The proppant control valve opening is adjusted to achieve the desired proppant concentration in the fracturing fluid.
(5) The pad pressure can be adjusted to a new value to extend the range of concentrations achievable.

FIG. 1 shows the relationship of proppant entrainment rate versus the motive flow rate (i.e., the flow rate of the water or liquid $CO_2$ flowing to the eductor) using a model 264 eductor manufactured by Schutte & Koerting. In FIG. 1, the line labeled "[1]" depicts the performance of the eductor pumping a proppant and water slurry using water as a motive fluid (as a "baseline" for comparison). The area and points marked "[2]" indicate similar conditions but instead $LCO_2$ has replaced water as the motive and suspension fluid. The low viscosity of liquid carbon dioxide (again as compared to that of water) is believed to account for the differences in trends between motive flow and entrainment rates and thereby requires a control strategy as provided in the present invention.

Figure 2:
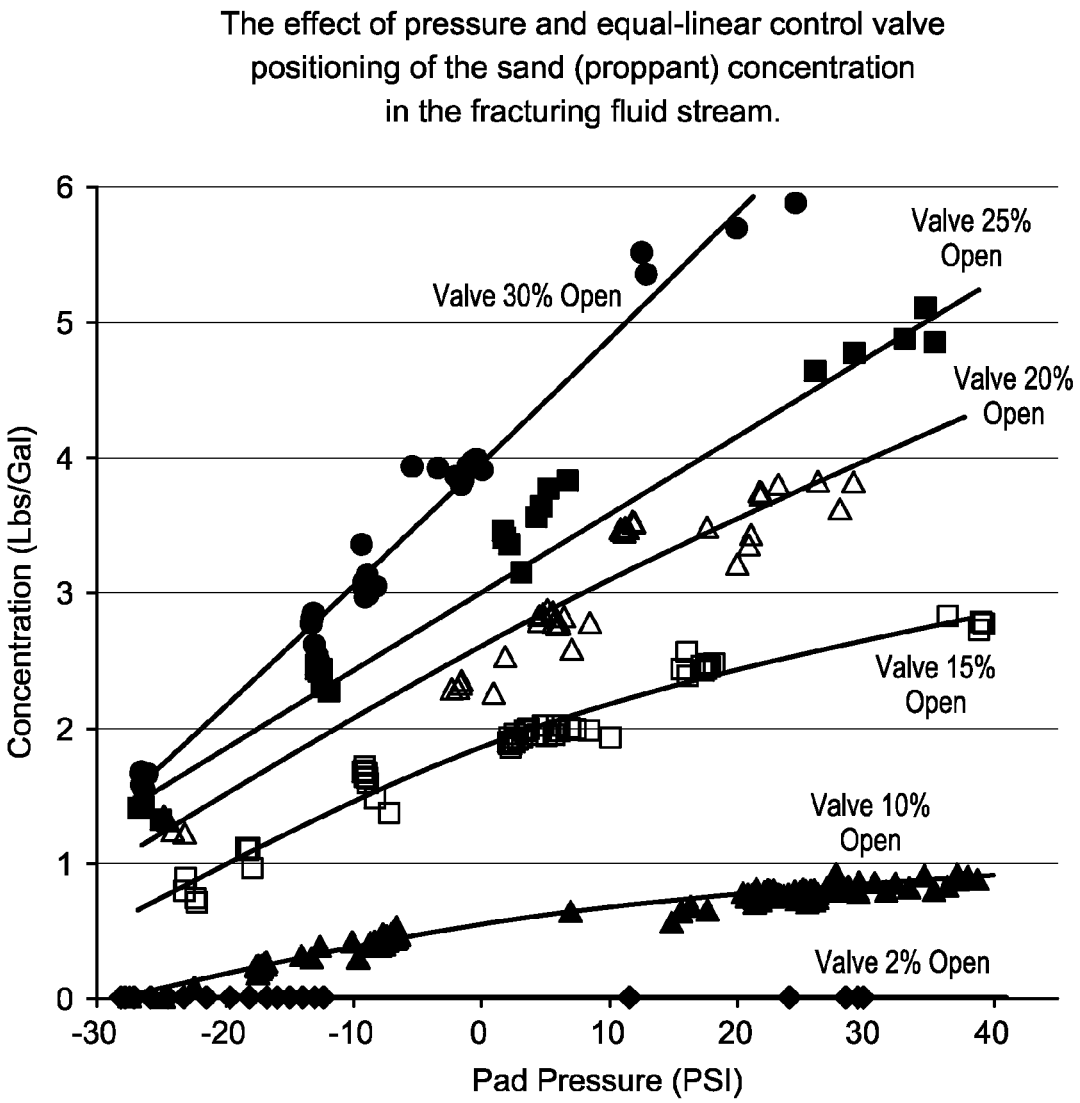
FIG. 2 is a plot showing the effect of pad pressure on the concentration of proppant in the fracturing fluid stream through various positions of a computer controlled valve.

FIG. 2 illustrates the proppant concentration as a function of pad pressure and proppant control valve (for example, an equal-linear type valve) position using liquid carbon dioxide as a fracturing fluid. FIG. 2 illustrates obtainable proppant concentration as a function of pad pressure and proppant control valve openings. As shown herein, the control system functions over a pad pressure ranging from −25 to +30 psi, and may still function over a range of −30 to +40 psi. In the present invention pad pressure is used as a means of coarse control of proppant loading while proppant control valve opening is used as a means for fine tuning the proppant loading.

Figure 3:
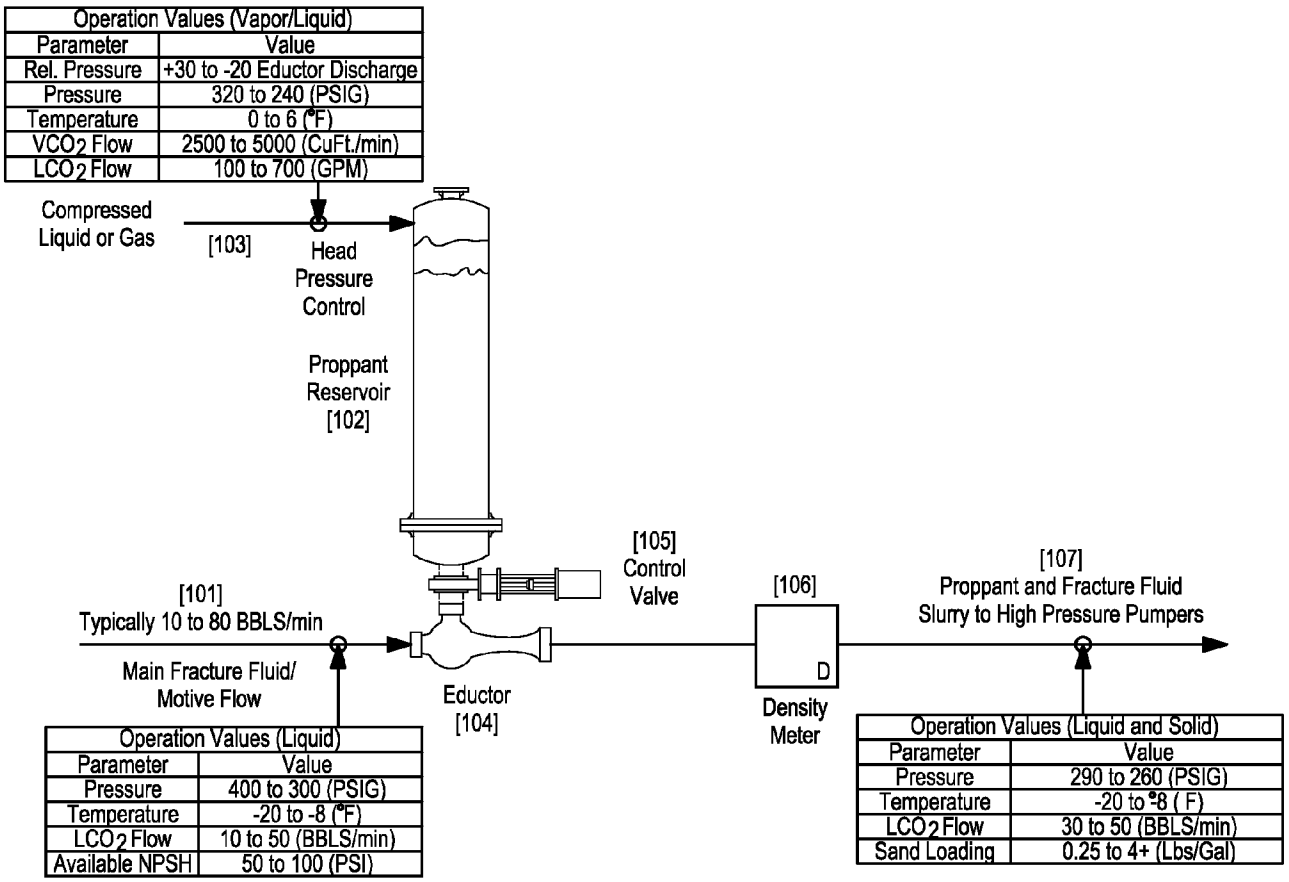
FIG. 3 is a schematic depicting an embodiment of the blender/reservoir system which provides controlled injection and mixing of proppant with a liquefied gas fluid for fracturing a geological formation utilizing an eductor.

FIG. 3 depicts an overview of the process using a flow diagram showing the basic elements of the present invention. Liquid carbon dioxide ($LCO_2$) fluid is supplied as stream 101. Typically, stream 101 would be supplied from a liquefied gas boost pump. The pressure of stream 101 is typically between 200 and 400 psig. The $LCO_2$ is routed through an eductor 104 and is mixed with proppant from the proppant reservoir 102, which is oriented in a position sufficient to provide proppant to the eductor, and preferably in a vertical or near vertical position. Moreover, the fluid in proppant reservoir 102, can be subcooled to provide the requisite NPSH downstream. For instance, decreasing the pressure in the reservoir and/or subcooling the liquid in the reservoir so the requisite NPSH is achieved. The eductor 104 serves the dual purpose of causing mixing within process piping as well as providing suction for drawing the proppant from the reservoir 102, thereby resulting in some degree of homogeneity in the product stream 107. Typical $LCO_2$ flow rates in a stream 101 for this system will be between 10 and 80 BBLS/min. An appropriate converging nozzle size in the eductor 104 is selected to produce a pressure drop of between 30 and 50 PSI for a selected liquid/motive flow 101. The recommended pressure drop in operation of the eductor 104 is between 15 PSI and 60 PSI, depending on the available "disposable" NPSH of the stream 107. During the fracturing operation, a proppant control valve 105 regulates the flow of proppant or proppant slurry from the proppant reservoir 102 into the eductor 104. One or more of these eductors can be placed and connected in parallel and perform as a single device. For instance, the two seven inch eductors can be utilized in place of a single nine inch eductor, depending on the flow rate necessitated. The eductors and other components of the system can be modularized, variable and switched out of the system. The meter 106 could be any one of or a combination of a nuclear densitometer, Coriolis meter, or other suitable measurement device that provides feedback on fracturing fluid loading concentration, density, or other parameter capable of determining proppant concentration prior to well head injection. The proppant control valve 105 opening can be adjusted based on the readings provided by meter 106. The volume of pressurized liquid or gas 103 supplied to the top of the proppant reservoir 102 allows for modification of the static pressure ranging from about 80-400 psi inside the proppant reservoir 102. An adjustment in the system's static pressure changes the overall flow capacity of proppant control valve 105. The resulting $LCO_2$ and proppant fracturing fluid is supplied to high pressure pumpers via stream 107. For a given or predetermined motive flow rate, either the proppant control valve 105 or the pad pressure, or both, is utilized to achieve the desired concentration by metering the proppant solution into the motive flow. In an alternative embodiment, a phase separator (not shown) or refrigeration system (not shown) can be utilized to remove vapor and provide condensed fracturing fluid after the eductor to the high pressure pumpers.

Figure 4:
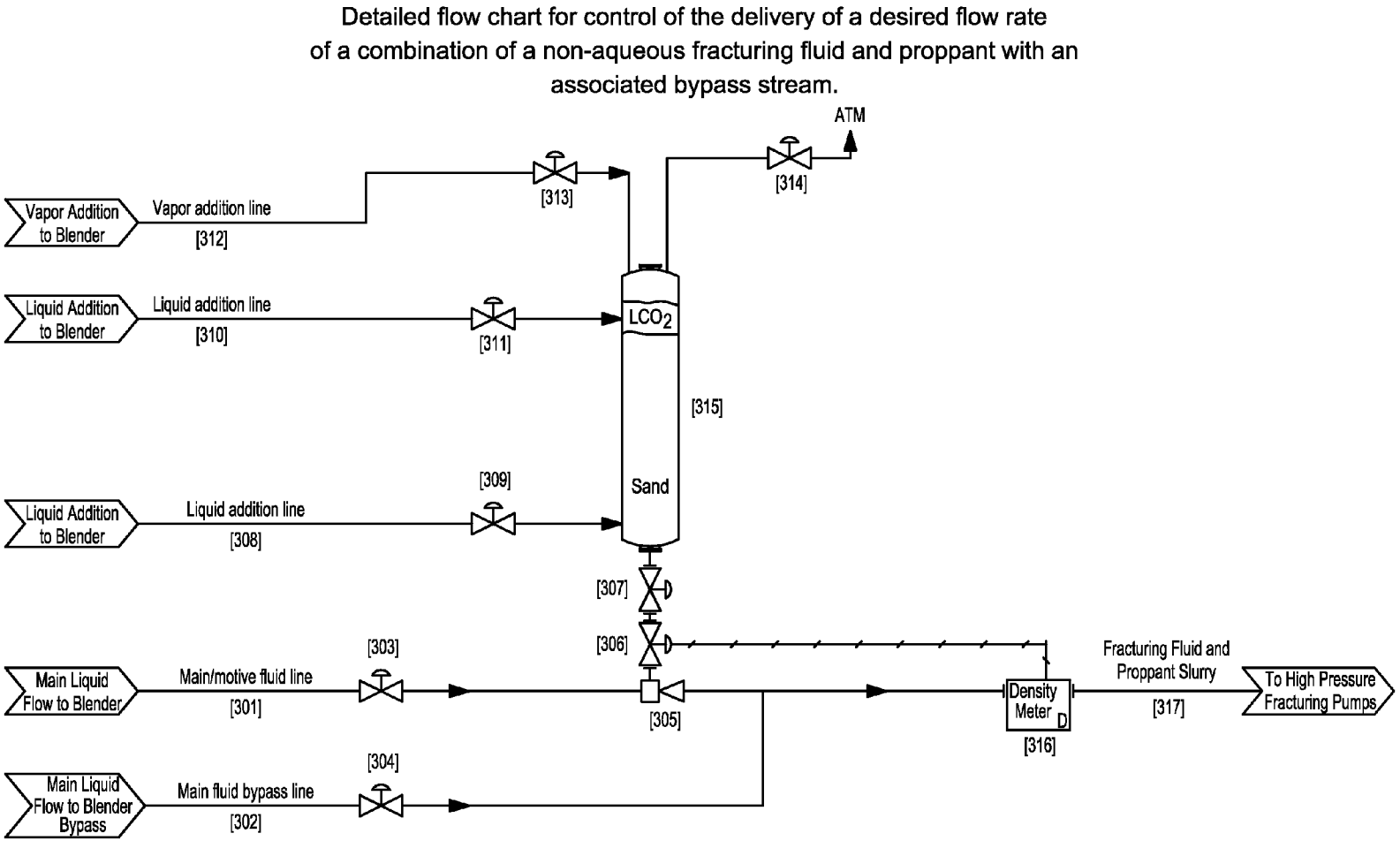
FIG. 4 is a further illustration of another embodiment of the overall system indicating certain process control aspects.

FIG. 4 is a schematic that illustrates another embodiment of the present invention. In this embodiment, a parallel slipstream 302 of $LCO_2$ can be provided that bypasses the eductor 305. This could be useful, for example, during the stages of the fracturing operation where no proppant is required (commonly referred to as the pad or padding stage). This bypass stream 302 can also be used to assist in controlling the final proppant loading. The flow into stream 302 and the motive stream 301 is controlled by flow control valves 304 and 303, respectively. The flow of the motive stream 301 is routed into eductor 305 where a proppant control valve 306 regulates the flow of proppant from the proppant reservoir 315 into eductor 305. An isolation valve 307, located between the control valve 306 and the proppant reservoir, is used to isolate the proppant reservoir 315 from the eductor 305. $LCO_2$ liquid is injected through line 308 to the bottom of the reservoir 315 to promote a liquid-solid suspension. Flow in line 308 is regulated by flow control valve 309 and actively provides for stirring of the proppant within the reservoir 315 during operation. This creates a dynamic dispersion that aids removal of proppant from the reservoir 315 and promotes uniformity and a degree of homogeneity of the slurry prior to entering eductor 305. A similar $LCO_2$ line 310 regulated by another flow control valve 311 provides fluid to the top portion of reservoir 315. This fluid is used to maintain a liquid $CO_2$ level above the proppant level in reservoir 315 to ensure that gas from the head space of the reservoir 315 does not enter eductor 305 and prevents vapor from passing through to the high pressure pumpers via line 317. Furthermore, maintaining this liquid cap also facilitates the flow of proppant from the reservoir 315 by reducing clumping and improving the flow behavior of the proppant. A pressurized gas line 312 can be utilized for injecting vapor to the top of the reservoir 315 for modification and control of the static pressure of the reservoir 315. Examples of gases that could be used to adjust the pressure include, but are not limited to carbon dioxide and nitrogen. The flow of pressurized gas into the proppant reservoir 315 is controlled through the use of a pressure control valve 313. Working in conjunction with the pressure control valve 313 is a pressure relief control valve 314. This valve works to relieve excess pressure stored in the head space of the proppant reservoir 315. The pressure in the head space of the proppant reservoir 315 can be both raised and lowered during operation via control valves 313 and 314. Head space pressure changes in the reservoir 315 results in an alteration of the overall flow capacity of the proppant loading control valve 306. A density meter 316 is used to determine the proppant loading during operation. The density reading data is used to modify the proppant control valve 306 opening in order to achieve a desired concentration. Fracturing fluid stream 317 is then sent to the high pressure pumpers. The high pressure pumpers further increase the pressure of the proppant and liquefied gas stream to surface treatment pressure and are in communication with the well head.

The control system and methodology for arriving at the desired proppant concentration is further explained in the Working Examples below. These examples, however, should not be construed as limiting the present invention.

Working Example 1: Motive Flow Rate of 20 BBLS/min

The data below in Table 1 provides a simulated example where the reservoir pad pressure (PP) and percent valve opening (VP) requirements (for a proppant control valve with a flow coefficient (CV) of 200) to obtain desired proppant concentrations from 0.25 to 4 lbs of proppant per gallon of $LCO_2$ in a fracturing fluid slurry as prescribed by a fracturing treatment schedule. The treatment schedule is utilized to provide a "pre-programmed" set of instructions (i.e., a PLC controller recipe is loaded into the system, and which communicate with the proppant control valve and adjust the pad pressure in the reservoir via the control loops). Naturally, an operator may manually override the recipe if necessary to modify the concentration of proppant in the slurry. Determining the control valve position and operating head pressure in the proppant reservoir is first determined through an iterative process carried out in the field. During fracturing operations, the pressure in the reservoir is adjusted to provide the designated pad pressure (PP) and valve position (VP) necessary in order to achieve the desired concentration based on a selected motive flow rate and the flow coefficient of the proppant control valve. The treatment schedule cannot be established without the proper determination of the pad pressure and proppant control valve position. In order to create the ability to provide a range of low end proppant loading to high end proppant loading, it is necessary to vary pad pressure to achieve proppant loading within predetermined ranges. The motive flow rate is set by determining the specific pumping rate required for the fracture treatment.

The system (such as described in any one of the exemplary embodiments above) is initially set at a low pad pressure, in this given example, a low pad pressure of −15 PSI is used. Setting the system at this low pressure allows for achieving better control of low proppant loadings (e.g. 0.25, 0.50 lbs/gal) using the proppant control valve. The proppant control valve is initially adjusted to increase proppant concentration in the fracturing fluid stream as prescribed by the treatment schedule, which is loaded in the PLC controller. In the example given the valve is adjusted from 10% to 40% open to achieve proppant loadings from 0.25 to 1.5 lbs/gal. After 1.5 lbs/gal is reached, the pad pressure is increased in order to better achieve higher proppant loadings (e.g. 3.5, 4.0, 4+, lbs/gal). In the example the pad pressure is adjusted from −15 PSI to 15 PSI. The pressure increase is done in a fashion were it has minimum impact on the proppant control valve position (in the example given this is done at 1.5 to 2.0 lbs/gal) and therefore is done at a specified loading. Once the new pad pressure has been established the process is completed through adjustments with the proppant control valve.

The following is done to minimize operational complexity: the head pressure is changed only once through the process; the system is adjusted using only one parameter at a time (either head pressure or proppant control valve position is changed, not both) or if two parameters are adjusted, one is changed minimally; the proppant control valve and pad pressure is adjusted in one direction (the head pressure is always increased and the proppant control valve opened only).

TABLE 1

Operating Conditions for Various Proppant Concentrations at a motive flow of 20 BBLS/Min Delivery to the Well Head

| Proppant Concentration (Lbs/Gal) | PP (PSI) | VP (% Open) CV 200 Setting/Position |
|---|---|---|
| 0.25 | −15 | 10% |
| 0.5 | −15 | 19% |
| 0.75 | −15 | 25% |
| 1 | −15 | 30% |
| 1.5 | −15 | 40% |
| 2 | 15 | 40% |
| 2.5 | 15 | 48% |
| 3 | 15 | 56% |
| 3.5 | 15 | 67% |
| 4 | 15 | 82% |
| 0.5 | 15 | 14% |
| 0 | 15 | 0% |

Working Example 2: Pilot Tests Conducted at 23 GPM of Motive Flow

Results from the operation of a pilot plant system similar to the one described above and shown in FIG. 3 are given in this Working Example 2. In this system, the concentration of the fracturing fluid was controlled by varying the proppant control valve opening while operating the proppant reservoir at "low" (i.e. between −5 and −27 psi) and "high" (i.e. between 11 and 27 psi) pad pressure conditions. The motive flow was 23 gallons per minute for both pad pressure conditions.

Figure 5:
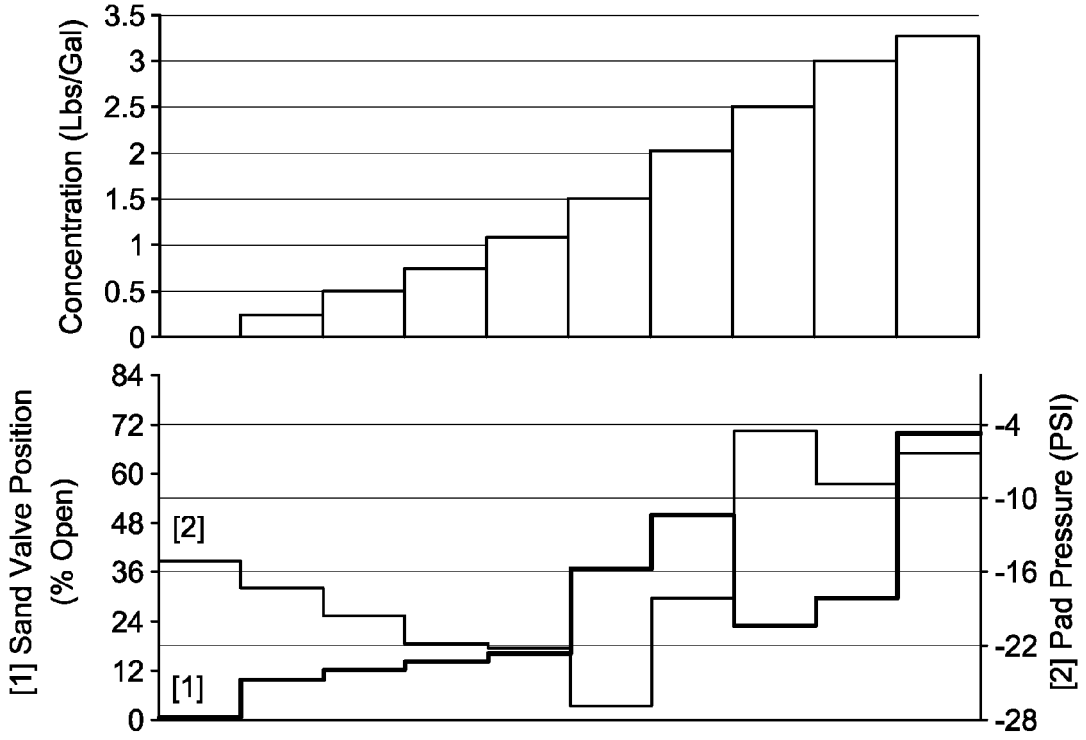
FIG. 5 is a graphical representation of various proppant control valve positioning at low pad pressures at a motive flow rate of 23 gal/min.
Figure 6:
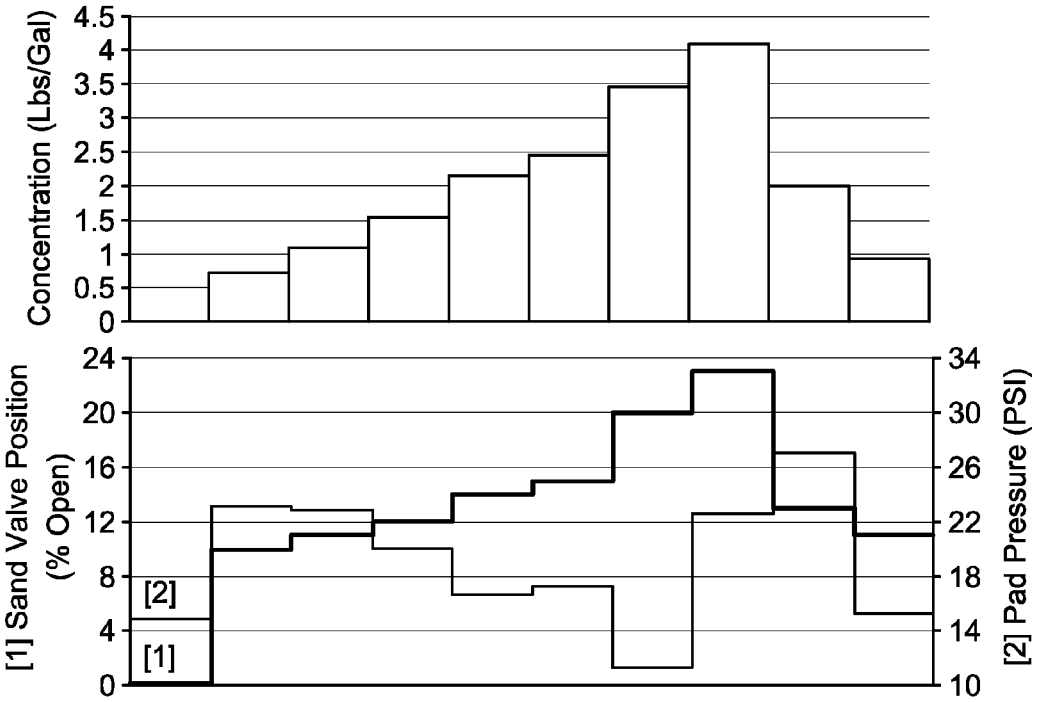
FIG. 6 is a graphical representation of various proppant control valve positioning at high pad pressures at a motive flow rate of 23 gal/min.

FIG. 5 illustrates the resulting concentration from pilot plant operations for the "low" pad pressure range. The proppant control valve varied from 8% to 70% open position and proppant concentrations from 0.25 to 3.27 lbs/gal were observed. The proppant concentration did not increase above 3.27 lbs/gal when the proppant control valve open position was increased above 70%. FIG. 6 illustrates the results of varying the proppant control valve position for the "high" pad pressure range. The control valve position varied from 10% to 23% open and concentrations from 0.75 to 4.04 lbs/gal were observed. The minimum achievable concentration for the "high" pad pressure condition was 0.75 lbs/gal.

The outcome of the "low" and "high" pad pressure pilot tests described in this example illustrates that it is necessary to change both the pad pressure and the proppant control valve position to achieve the full range of proppant loadings required for a fracturing treatment (e.g. 0.25 to 4.0+ lbs/gal).

While the invention has been describe in detail with reference to exemplary embodiments thereof, it will become apparent to one skilled in the art that various changes and modifications can be made, and equivalents employed, without departing from the scope of the appended claims.

What is claimed is:

1. A method of controlling a proppant concentration in a fracturing fluid that is utilized in stimulation of an underground formation, comprising:

supplying a motive fluid flow of liquefied gas at pressure between about 150 to 400 psig to at least one eductor, wherein the liquefied gas is mixed with proppant or proppant slurry in the eductor to form a fracturing fluid, wherein a pressurized proppant reservoir is disposed in a position to supply the proppant slurry to the at least one eductor;

varying a pad pressure in the pressurized proppant reservoir from about −30 to 40 psi; and further varying a proppant control valve disposed between the eductor and the pressurized proppant reservoir to control the proppant concentration in a range from about 0.1 to 10 lbs/gal of proppant in the fracturing fluid.

2. The method of claim 1 wherein the pressure of the liquefied gas supplied to the eductor is between about 200 and 300 psig.

3. The method of claim 1, wherein the motive fluid flow of liquefied gas is predominantly carbon dioxide.

4. The method of claim 1, further comprising: wherein the motive fluid flow rate ranges from about 10-80 barrels per minute.

5. The method of claim 1, further comprising: metering the proppant into the motive fluid flow without utilizing an auger.

6. The method of claim 1, further comprising: sizing the eductor and setting the motive fluid flow to attain a pressure drop of the liquefied gas through the eductor from about 15 to 60 psi.

7. The method of claim 1, further comprising: providing a portion of the motive fluid flow of liquefied gas through a bypass line downstream of the eductor.

8. The method of claim 1, further comprising: providing liquefied gas to the upper part of the proppant reservoir to control the pad pressure or to maintain a liquid cap above the proppant medium therein.

9. The method of claim 1, further comprising: providing a pressurized gas to the upper part of the proppant reservoir to control the pad pressure.

10. The method of claim 9, wherein the pressurized gas comprises carbon dioxide or nitrogen.

11. The method of claim 1, further comprising: lowering the pad pressure through the use of a pressure relief control valve.

12. The method of claim 1, further comprising: providing liquefied gas to a lower part of the proppant reservoir to aid the mixing of proppant and liquefied gas contained therein.

13. The method of claim 1, further comprising: wherein the proppant concentration in the fracturing fluid is measured by a densitometer, or a concentration meter disposed downstream of the eductor.

14. The method of claim 1, further comprising: providing at least two eductors connected in parallel to form the fracturing fluid.

15. The method of claim 1, further comprising: subcooling the proppant or proppant slurry in the pressurized proppant reservoir to provide a requisite net positive suction head pressure downstream.

* * * * *